US009011261B2

(12) United States Patent
Hamelin

(10) Patent No.: US 9,011,261 B2
(45) Date of Patent: Apr. 21, 2015

(54) ROTATING WATER PLAY DEVICE

(71) Applicant: Stella Hamelin Holdings Inc., Pointe-Claire (CA)

(72) Inventor: Stephen Hamelin, L'ile-Cadieux (CA)

(73) Assignee: Stella Hamelin Holdings Inc., Pointe-Claire, Quebec (CA)

( * ) Notice: Subject to any disclaimer, the term of this patent is extended or adjusted under 35 U.S.C. 154(b) by 23 days.

(21) Appl. No.: 14/037,757

(22) Filed: Sep. 26, 2013

(65) Prior Publication Data

US 2014/0094086 A1 Apr. 3, 2014

Related U.S. Application Data

(60) Provisional application No. 61/707,294, filed on Sep. 28, 2012.

(51) Int. Cl.

| | |
|---|---|
| ***A63G 31/00*** | (2006.01) |
| ***A63H 23/10*** | (2006.01) |
| *B05B 15/00* | (2006.01) |

(52) U.S. Cl.

CPC ..... *A63H 23/10* (2013.01); *A63G 31/007* (2013.01)

(58) Field of Classification Search

USPC ..... 472/13, 117, 128, 129; 446/153, 156, 446/158; 239/289

See application file for complete search history.

(56) References Cited

U.S. PATENT DOCUMENTS

| | | | | |
|---|---|---|---|---|
| 3,322,347 | A * | 5/1967 | Pierce | 239/73 |
| 3,866,916 | A * | 2/1975 | Clarke | 273/338 |
| 4,689,032 | A * | 8/1987 | Trossman | 446/160 |
| 5,299,588 | A * | 4/1994 | MacLeod | 135/16 |
| 5,505,645 | A * | 4/1996 | Engler, Jr. | 441/1 |
| 6,319,139 | B1 * | 11/2001 | Tracy | 472/128 |
| 6,739,979 | B2 * | 5/2004 | Tracy | 472/128 |
| 6,808,457 | B1 * | 10/2004 | Paukert et al. | 472/14 |
| 6,886,759 | B1 * | 5/2005 | Okronick et al. | 239/289 |

* cited by examiner

*Primary Examiner* — Kien Nguyen

(74) *Attorney, Agent, or Firm* — Brouillette & Partners; Robert Brouillette

(57) ABSTRACT

A rotating water play device generally comprises a static shaft typically fixedly mounted to a ground surface and a platform mounted for rotation on the shaft. The platform allows at least one person to stand on it and impart a rotating motion thereto. The shaft is configured to be connected to a water source and comprises a hollow axial bore and at least one radial opening. The platform comprises a sleeve pivotally mounted to the shaft, the sleeve comprising at least one radial opening in fluid communication with at least one dispensing opening located on the platform, typically at the periphery thereof. The radial openings of the shaft and of the sleeve are configured to be in intermittent or continuous fluid communication, whereby water can flow through the shaft and then through the platform before exiting the platform.

28 Claims, 8 Drawing Sheets

ROTATING WATER PLAY DEVICE

CROSS-REFERENCE TO RELATED APPLICATIONS

The present patent application claims the benefits of priority of U.S. Provisional Patent Application No. 61/707,294, entitled "Rotating Water Play Device", and filed at the United States Patent and Trademark Office on Sep. 28, 2012, the content of which is incorporated herein by reference.

FIELD OF THE INVENTION

The present invention generally relates to water play apparatuses and devices and more particularly relates to rotating water play apparatuses and devices.

BACKGROUND OF THE INVENTION

Over the past several years, cities, amusement parks, hotels, and other facilities catering to family recreation and leisure have been installing aquatic or water play areas.

These play areas, also referred to as splash pads, spray parks, spray grounds and wet decks, are typically provided with different water dispensing devices such as, but not limited to, water canons, spray arches, ground sprays, and the like.

Some water dispensing devices are fixed and typically passive in that they cannot be interacted with (e.g. spray arches). In other words, in such passive devices, the water is typically dispensed relatively independently of the actions of the users.

Other water dispensing devices are interactive in that the users can actively change the way the water is dispensed (e.g. water canons).

Understandably, interactive devices are typically more appreciated by the users since they can actually control or manipulate the devices.

However, despite the wide variety of available interactive water play devices, there is a lack of water play devices which dispense water as they rotate under the action of the users.

Hence, despite ongoing development in the field of water play devices, there is still a need for a novel interactive rotating water play device.

SUMMARY OF THE INVENTION

A rotating water play device, in accordance with the principles of the present invention, generally comprises a static shaft structure configured to be connected to a water source, and a platform assembly mounted for rotation on the static shaft structure and configured to be a fluid communication with the shaft structure for dispensing water.

The shaft structure generally comprises a base configured to be mounted to a ground surface and to be connected to water source, and a hollow shaft extending upwardly from the base and supporting the platform assembly for rotation.

The base and the hollow shaft define a fluid path in order to allow the water of the water source to flow through the base and through the shaft. In that sense, the base comprises an internal passage (e.g. a bore, a chamber) and the hollow shaft comprises a generally axial bore, the axial bore and the internal passage forming the fluid path. The hollow shaft also comprises at least one, but typically a plurality of radial openings extending from the radial bore.

For its part, the platform assembly comprises a platform which is configured to support at least one person or user and which is mounted for rotation on the shaft. In that sense, the platform generally comprises a sleeve pivotally mounted to the shaft. The sleeve comprises at least one, but typically a plurality of radial openings.

The platform further comprises at least one but typically a plurality of water dispensing openings typically, but not necessarily, located at the periphery thereof.

The dispensing openings are in fluid communication with the radial openings of the sleeve via one or more fluid paths (e.g. internal reservoir, internal chambers, internal channels, etc.) located and/or extending into the platform.

In some non-limitative embodiments, the radial openings of the sleeve are configured to be intermittently in fluid communication with the radial openings of the shaft, thereby allowing the device to dispense water intermittently. In such embodiments, the radial openings of the sleeve are configured to be repeatedly in registry with the radial openings of the shaft during rotation of the platform assembly. Hence, the device can typically dispense water only when the radial openings of the shaft and of the sleeve are in registry.

In some other non-limitative embodiments, the radial openings of the sleeve are configured to be continuously in fluid communication with the radial openings of the shaft, thereby allowing the device to continuously dispense water. In such embodiments, the shaft and/or the sleeve typically comprises a circumferential groove overlapping the radial openings to form a circumferential channel between the radial openings of the shaft and of the sleeve in which water can continuously flow.

In use, a user will be able to step on the platform and impart a rotating motion thereto. Then, depending on the configuration of the shaft and of the sleeve, the platform will dispense water intermittently or continuously as the water flows through the base, through the shaft, through both sets of radial openings, and then through the platform to be ultimately dispensed via the dispensing openings.

A rotating water dispensing device in accordance with the principles of the present invention therefore allows a rotating dispensing of water which is responsive to the actions of the user or users. Such interactive rotating dispensing of water provides entertainment to the person or persons located around the device and/or to the user or users located on the device.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which.

DETAILED DESCRIPTION OF THE PREFERRED EMBODIMENT

A novel rotating water play device will be described hereinafter. Although the invention is described in terms of specific illustrative embodiments, it is to be understood that the embodiments described herein are by way of example only and that the scope of the invention is not intended to be limited thereby.

Figure 1:
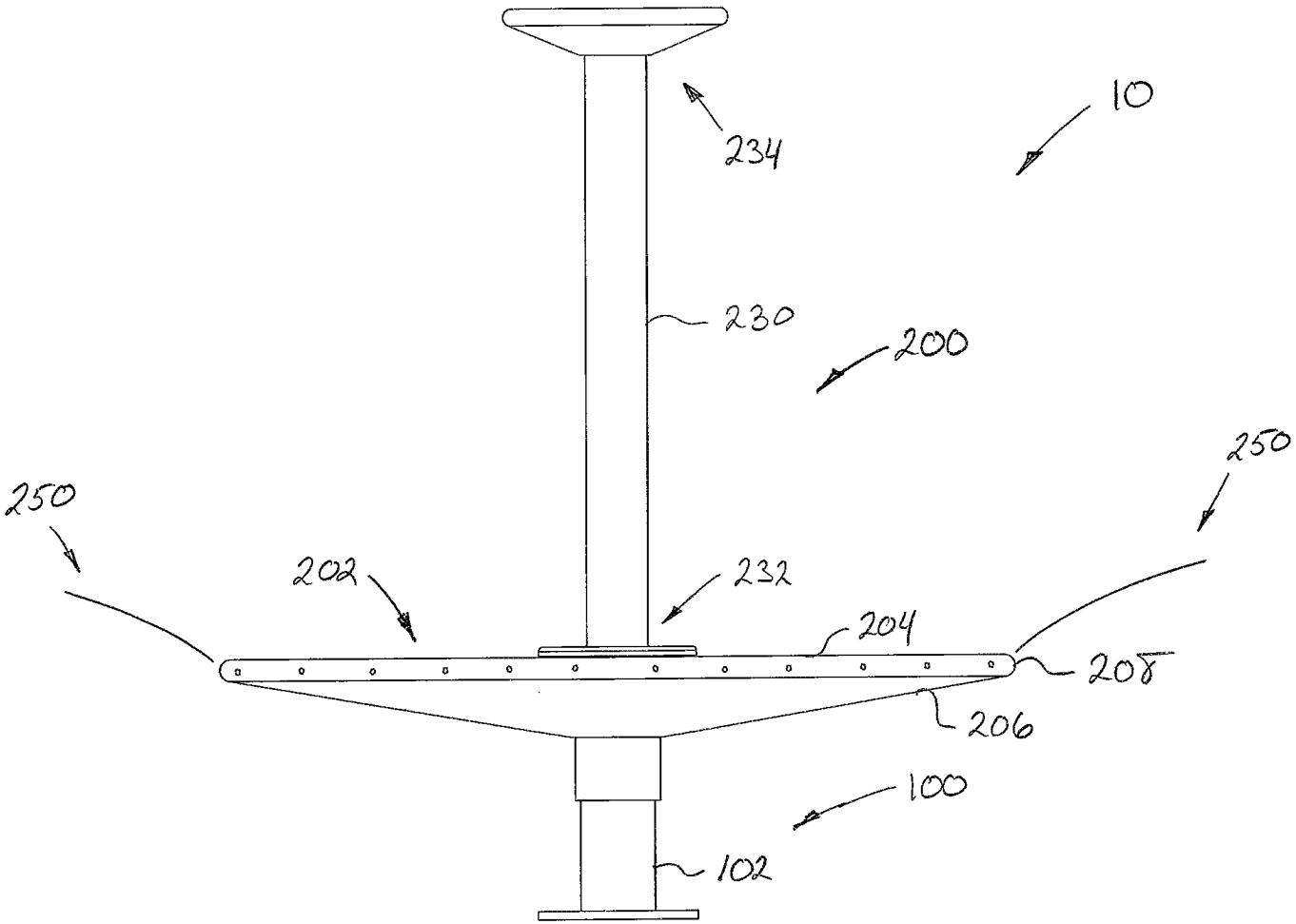
FIG. 1 is a side view of an embodiment of a rotating water play device in accordance with the principles of the present invention.
Figure 2:
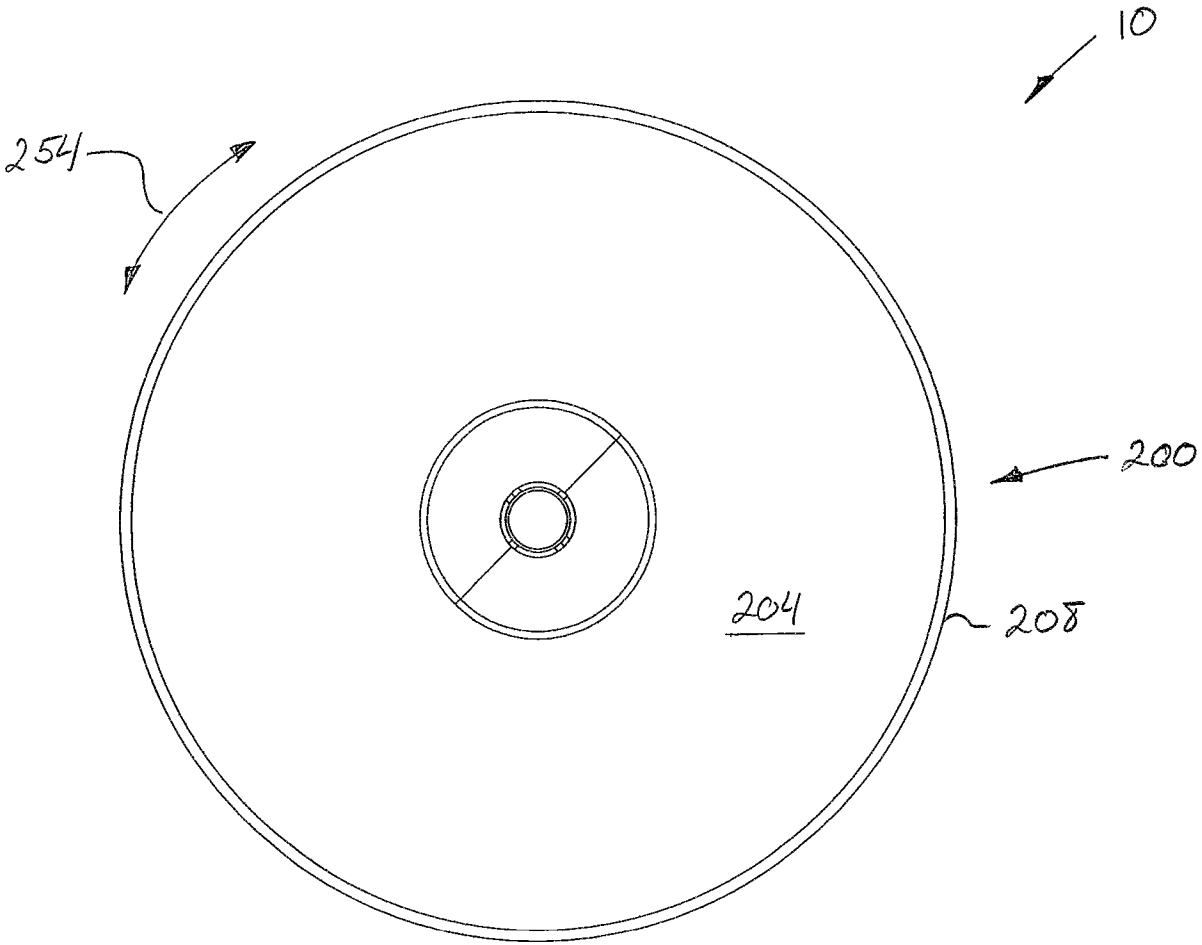
FIG. 2 is a top view of the rotating water play device of FIG. 1.

Referring first to FIGS. 1 and 2, a rotating water play device 10, in accordance with the principles of the present invention, is illustrated. In the present embodiment, the device 10 is generally configured as a "merry go round" though in other embodiments, the device could be configured differently.

The device 10 generally comprises a static shaft structure 100 and a platform assembly 200 mounted for rotation on the shaft structure 100. The shaft structure 100 generally provides the necessary support for the platform assembly 200 which will support and/or accommodate at least one user. As it will be best understood below, the platform assembly 200 is configured to be imparted a clockwise or counter-clockwise rotating movement 254 (see FIG. 2) under the action of one or more users, thereby allowing the device 10 to dispense water 250 (and 252) while rotating (see FIGS. 1 and 7).

In accordance with the principles of the present invention, the shaft structure 100, which is connectable to a water source (not shown), and the platform assembly 200, are configured to be in fluid communication, either intermittently or continuously, to allow the platform assembly 200 to dispense water 250 while rotating under the action of at least one user.

Figure 3:
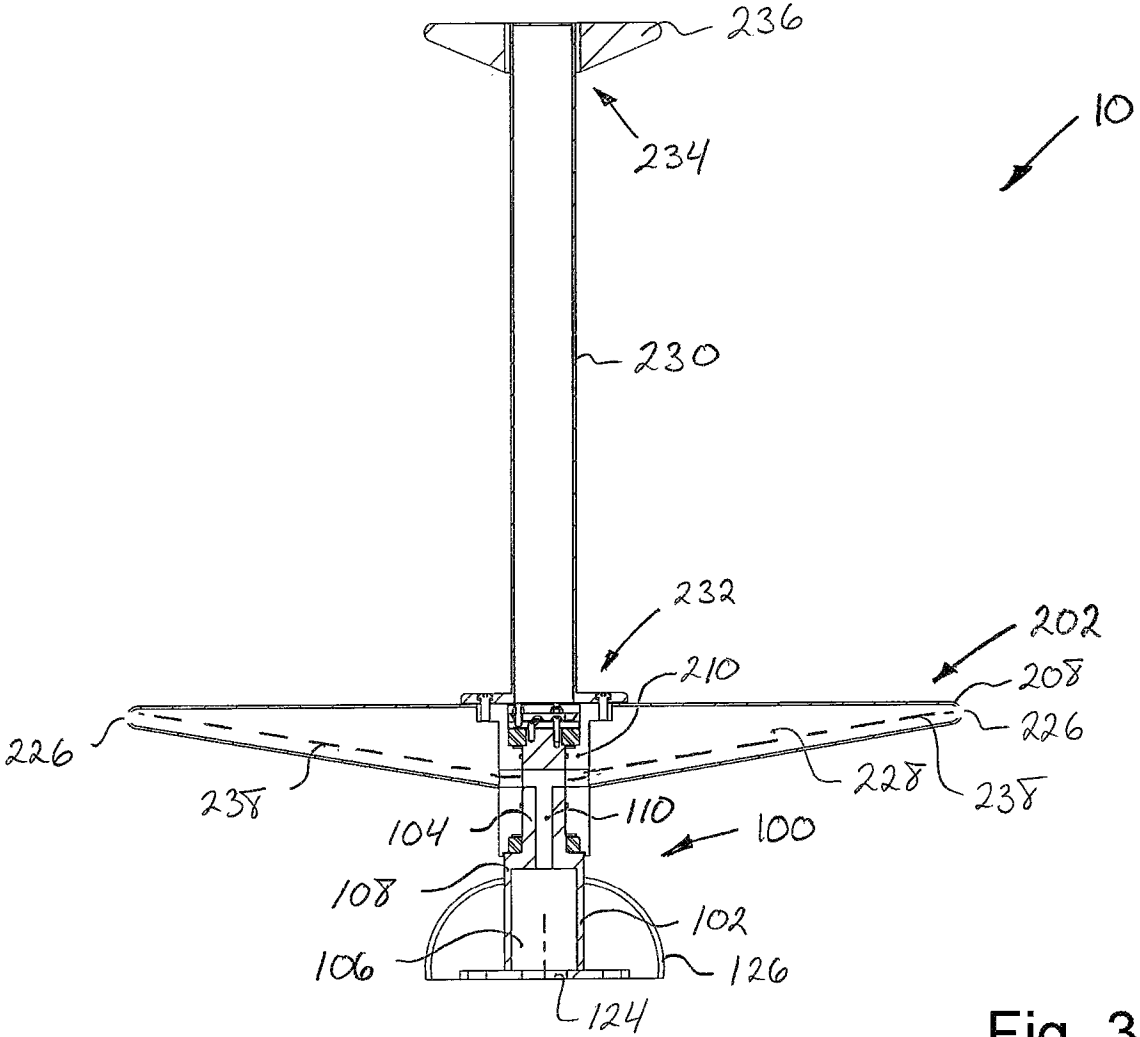
FIG. 3 is a cross-sectional side view of the rotating water play device of FIG. 1.

With additional reference to FIG. 3, the shaft structure 100 generally comprises a base 102 configured to be fixedly secured to a ground surface (not shown), and a shaft 104 extending upwardly from the base 102 and to which the platform assembly 200 is mounted for rotation.

Understandably, the expression "ground surface" must be construed broadly as the water play device 10 could be installed in a water play area located, for example, on the deck a of cruise ship, or on an elevated playground structure.

The base 102 comprises an internal passage 106 (e.g. a bore, a conduit, a chamber, etc.) which is configured to be connected to the water source. In the present embodiment, the chamber 106 is configured to be connected to an underground water pipe (not shown) and, as such, comprises a bottom opening 124 providing a passage between the underground water pipe and the internal passage 106.

In other embodiments, the base 102 could be connectable to an external pipe or hose and, as such, would generally comprise a water inlet (not shown) configured to be connected to the external pipe or hose.

Figure 4:
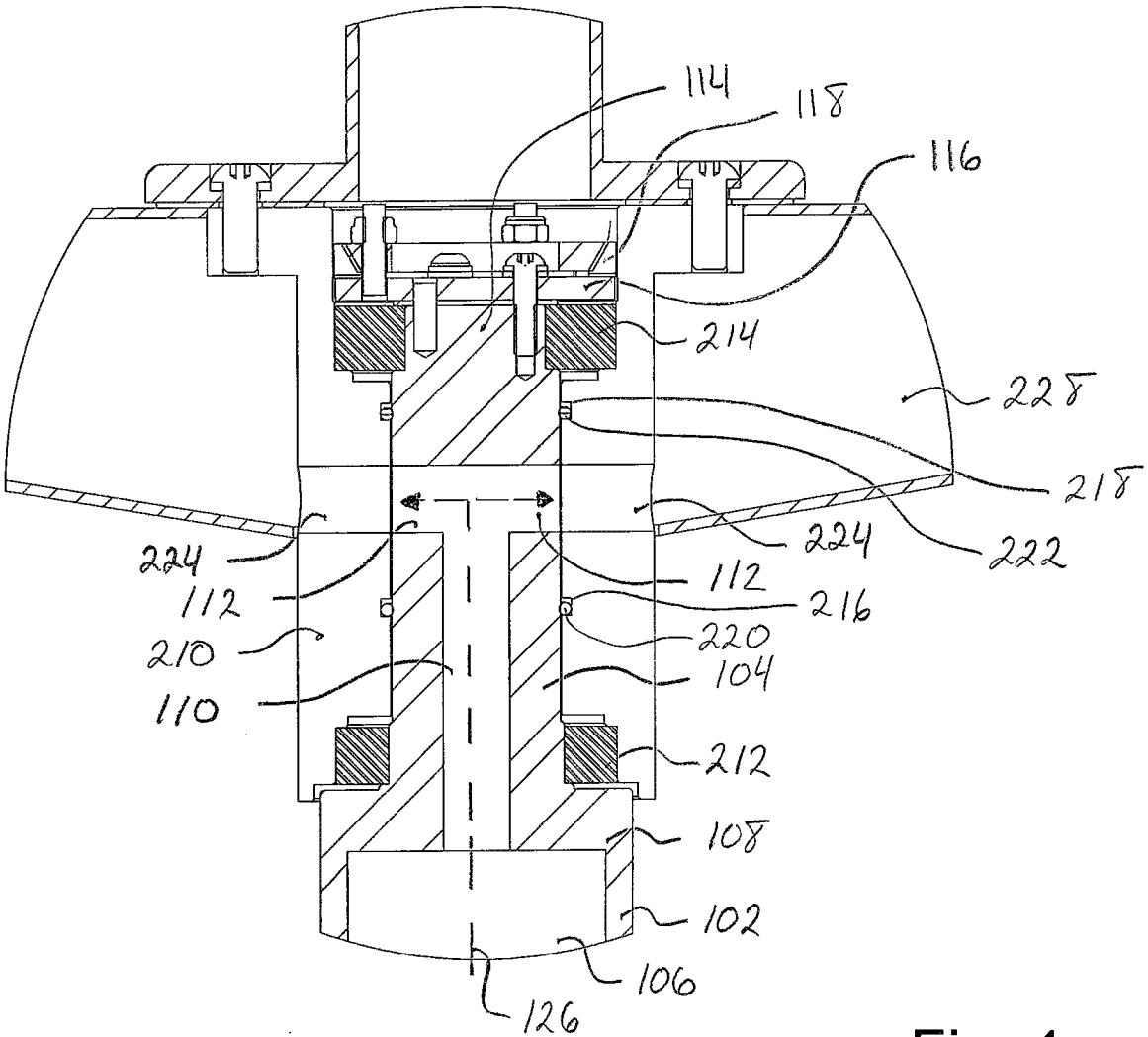
FIG. 4 is an enlarged cross-sectional side view of the shaft and of the sleeve of the rotating water play device of FIG. 1.

Referring now to FIGS. 3 and 4, the shaft 104 of the shaft structure 100 extends upwardly from the upper end 108 of the base 102, and comprises a generally axially extending bore 110 which is in fluid communication with the internal passage 106, and at least one radial opening 112 extending from the axial bore 110.

In the present embodiment, the shaft 104 comprises a plurality of radial opening 112 (two are shown) which are evenly disposed about the shaft 104 (see FIGS. 3 and 4). Still, in other embodiments, the radial openings may be unevenly disposed about the shaft 104.

The internal passage 106, the axial bore 110 and the radial openings 112 define a first fluid path 126 in the shaft structure 100 which allows the water coming from the water source to flow through the shaft structure 100.

As it will be best understood below, in the embodiment shown in FIGS. 3 and 4, the radial openings 112 in the shaft 104 are configured to be placed in registry with corresponding radial openings 224 in the sleeve 210 of the platform assembly 200 as the platform assembly 200 rotates in order to allow the water flowing through the shaft 104 to flow into the platform 202.

Still referring to FIGS. 3 and 4, the free end 114 of the shaft 104 is terminated by a removable end cap 116 which prevents unwanted upward movements of the platform assembly 200 during use. However, the end cap 116 is removable to allow the installation and removal of the platform assembly 200 on the shaft 104.

As best shown in FIG. 4, in the present embodiment, the end cap 116 further comprises a speed control assembly 118 which can be adjusted to control the speed of the platform assembly 200 with respect to the shaft 104.

In order to properly support the weight of the platform assembly 200 and of the one or more users standing on the platform 202, the base 102, the shaft 104 and the sleeve 210 are typically made of metal or other similarly strong material. Also, since the base 102, the shaft 104 and the sleeve 210 will be exposed to water, the material(s) from which they are made should also be resistant to corrosion. In the present embodiment, the base 102, the shaft 104 and the sleeve 210 are made from stainless steel.

In the present embodiment, since the device 10 is typically intended to be used in a water play area where users are walking or running around bare foot, the base 102 is surrounded by a protective toe guard 126 (see FIG. 3). The toe guard 126 is typically made of elastomeric material in order to absorb impacts between the toes of a person and the base 102 of the shaft structure 100.

Referring back to FIGS. 1 and 2, the platform assembly 200 generally comprises a platform 202 having a top surface 204, a bottom surface 206, and an outer periphery 208. In the present embodiment, and as best shown in FIG. 2, the platform 202 is of circular configuration. However, in other embodiments, the platform 202 could have other configurations.

With additional reference to FIGS. 3 and 4, the platform 202 comprises the sleeve 210, already introduced above, which is pivotally mounted to the shaft 104 of the base structure 100.

In the present embodiment, the sleeve 210 is mounted to the shaft 104 via a pair of lower and upper bearings 212 and 214 which allow proper rotation of the sleeve 210 with respect to the shaft 104.

As already mentioned above, the sleeve 210 comprises at least one radial opening 224 configured to be placed in registry with the at least one corresponding radial opening 112 of the shaft 104 as the platform assembly 200 rotates (see FIG. 4).

In the present embodiment, the sleeve 210 comprises a plurality of such radial openings 224 (two are shown) which are evenly disposed about the sleeve 210. In other embodiments, the radial openings 224 could be unevenly disposed about the sleeve 210.

The radial openings 224 of the sleeve 210 are in fluidly communication with dispensing openings 226 located in the platform 202, typically at the periphery 208 thereof, via one or more internal passages. In the present embodiment, the internal passages are configured as internal reservoirs or chambers 228 located within the platform 202. In other embodiments, the internal passages could be configured as internal channels, internal pipes, internal conduits, etc.

The radial openings 224 in the sleeve 210, the internal reservoir 228 and the dispensing openings 226 define a second fluid path 238 which allows the water coming from the shaft structure 100 to flow through the platform 202 of the platform assembly 200.

To prevent leaks between the shaft 104 and the sleeve 210 as water flows therethrough, the sleeve 210 comprises a pair of internal lower and upper circumferential grooves 216 and 218 in which are respectively disposed lower and upper ring seals 220 and 222.

In the present embodiment, the platform assembly 200 also comprises a pole 230 fixedly mounted at its lower end 232 to the top surface 204 of the platform 202, and terminated at its upper end 234 by a handle 236.

Figure 7:
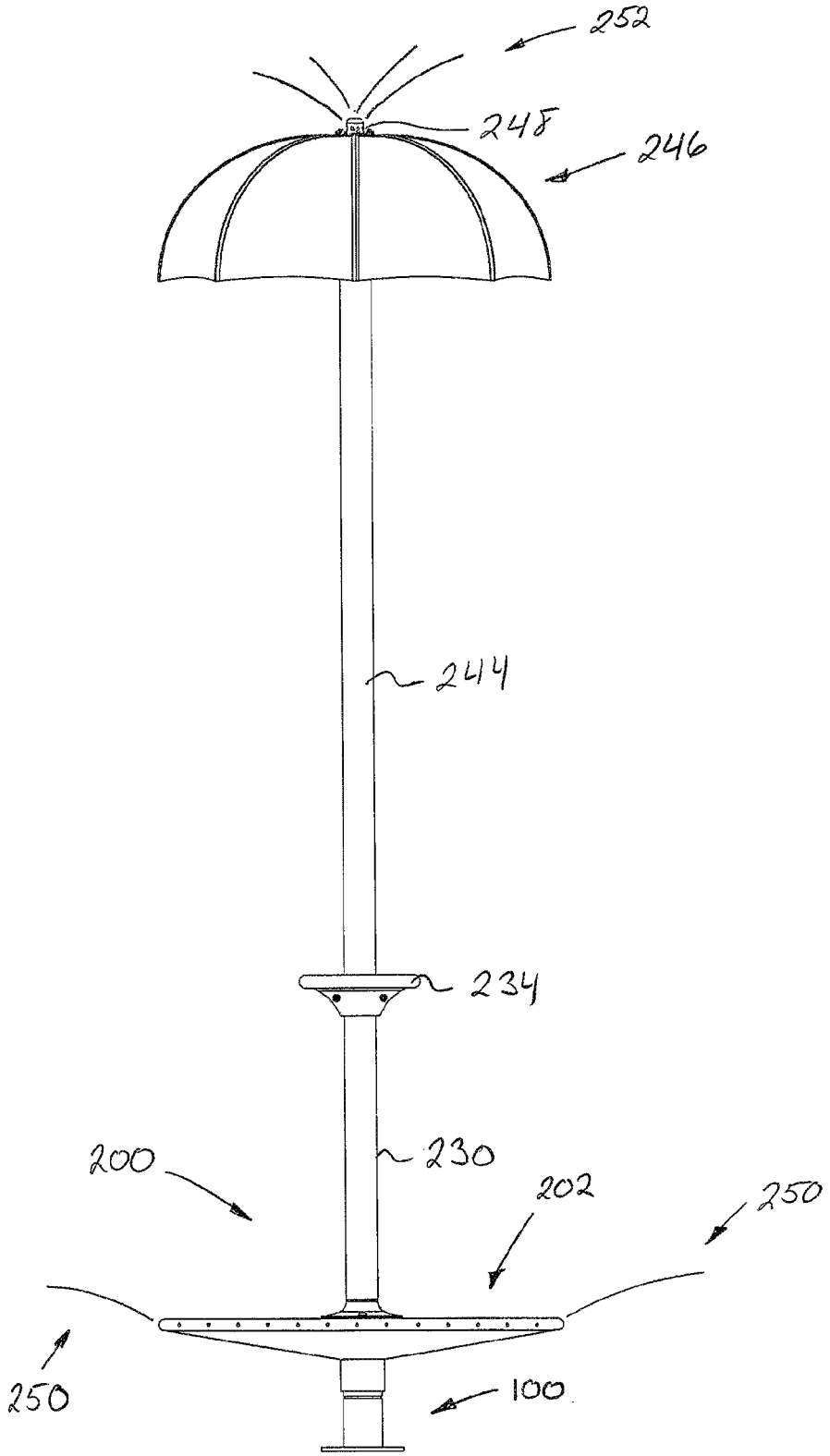
FIG. 7 is a side view of another embodiment of a rotating water play device in accordance with the principles of the present invention.

In the present embodiment, the pole 230 is fixedly yet removably mounted (e.g.

bolted) to the platform 202 such as to be removable and replaceable by a new pole or by a different structure if necessary (see FIG. 7).

The platform assembly 200 is configured to allow at least one person to stand on it and impart a rotating motion 254 thereto (see FIG. 2). In that sense, the person, or persons, standing on the platform 202 will typically hold the handle 236 in order to avoid tipping over due to the centrifugal forces.

In use, the device 10 will be connected to the water source (e.g. an underground pipe, an external pipe, etc.). Then as a person steps on the platform 202 and starts imparting a rotating movement 254 to it, the radial openings 112 of the shaft 104 and the radial openings 224 of the sleeve 210 will regularly be placed in registry, forming a continuous fluid path 126/238 between the water source and the dispensing openings 226 and thereby allowing water to intermittently flow from the shaft structure 100 and into the platform 202 where it will be dispensed by the dispensing openings 226 (see FIG. 1).

Figure 5:
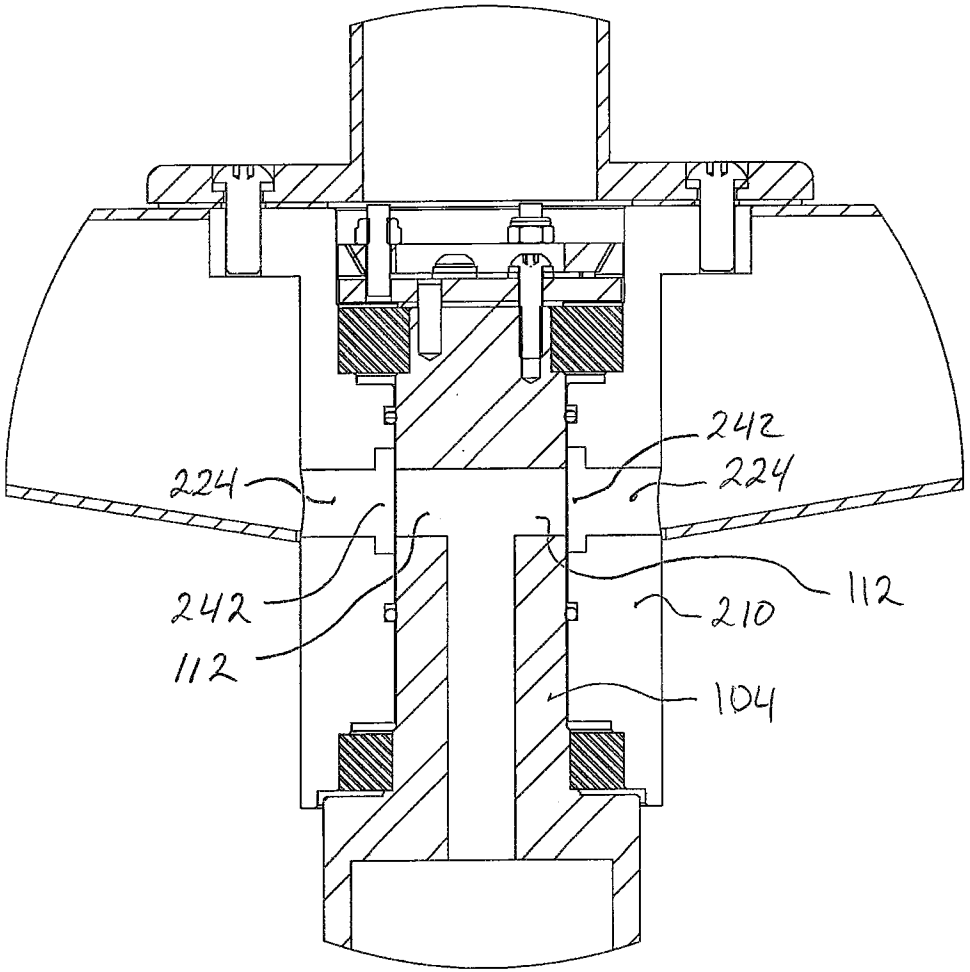
FIG. 5 is an enlarged cross-sectional side view of the shaft and of the sleeve of another embodiment of a rotating water play device in accordance with the principles of the present invention.
Figure 6:
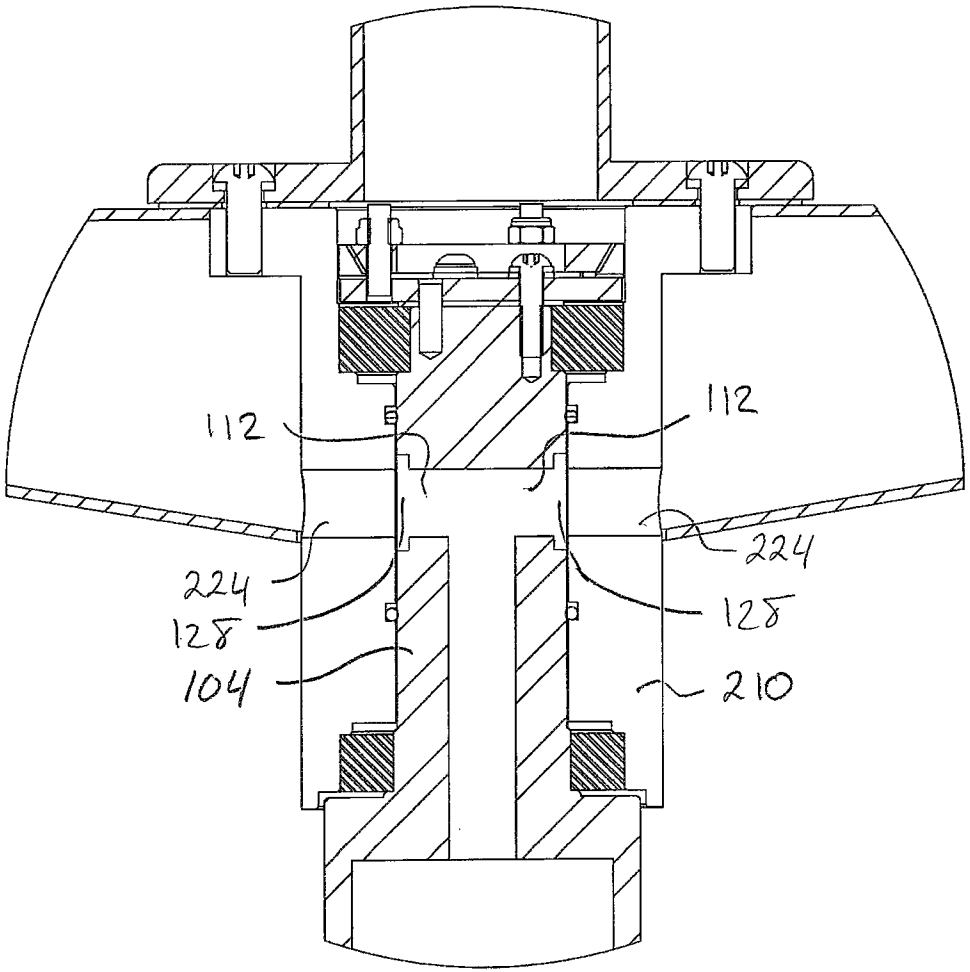
FIG. 6 is an enlarged cross-sectional side view of the shaft and of the sleeve of still another embodiment of a rotating water play device in accordance with the principles of the present invention.

Referring now to FIGS. 5 and 6, in other embodiments, the sleeve 210 and/or the shaft 104 can be configured to allow continuous dispensing of the water during use of the device 10.

In FIG. 5, the sleeve 210 further comprises a circumferential groove 242 overlapping the radial openings 224. The groove 242 forms a circumferential channel between the radial openings 112 of the shaft 104 and the radial openings 224 of the sleeve 210. The circumferential channel allows water to flow continuously between the radial openings 112 of the shaft 104 and the radial openings 224 of the sleeve 210, thereby allowing continuous dispensing of the water during use of the device 10.

In FIG. 6, it is the shaft 104 that comprises a circumferential groove 128 overlapping the radial openings 112. As the groove 242 of FIG. 5, the groove 128 forms a circumferential channel between the radial openings 112 of the shaft 104 and the radial openings 224 of the sleeve 210 which allows water to flow continuously between the radial openings 112 of the shaft 104 and the radial openings 224 of the sleeve 210, thereby allowing continuous dispensing of the water during use of the device 10.

Understandably, in some embodiments, both the shaft 104 and the sleeve 210 could comprise a circumferential groove.

Figure 8:
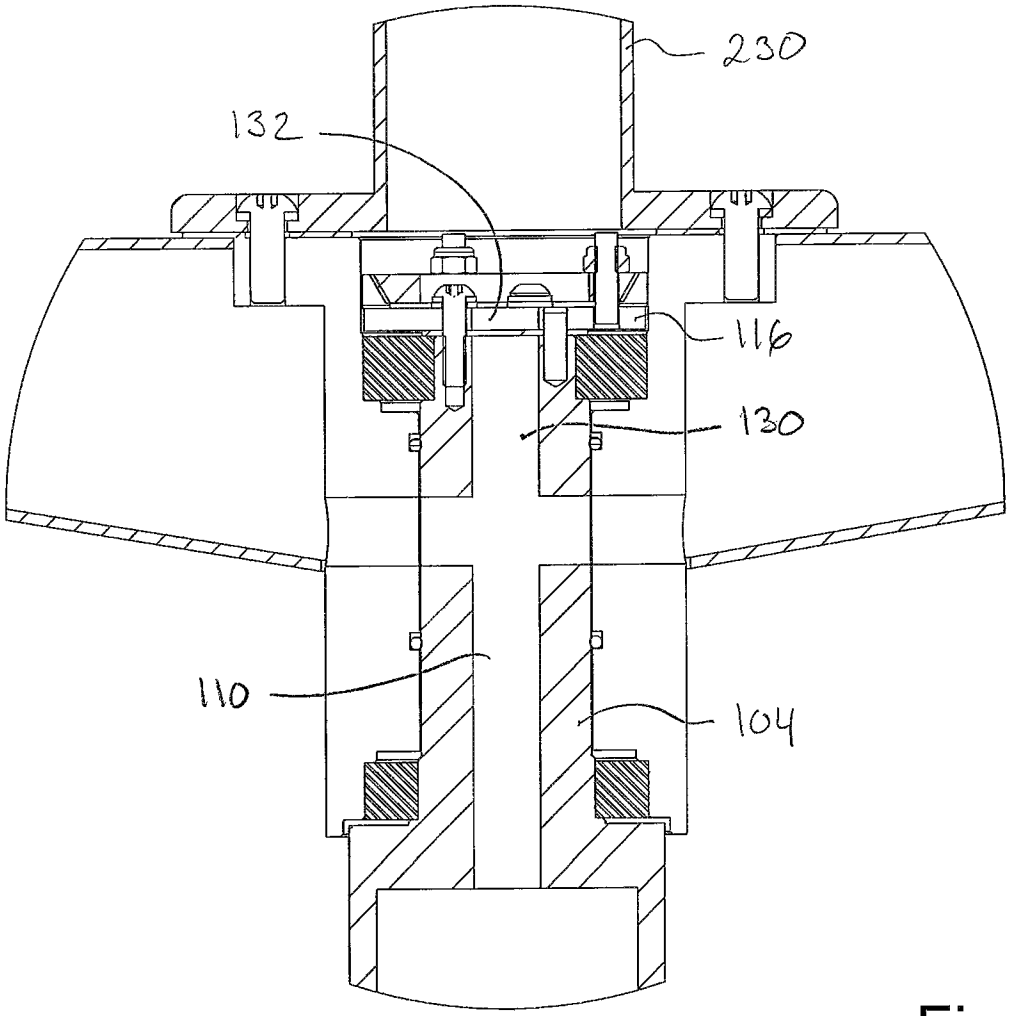
FIG. 8 is an enlarged cross-sectional side view of the shaft and of the sleeve of the rotating water play device of FIG. 7.

Referring now to FIGS. 7 and 8, in still other embodiments, the shaft 104 could further comprise an axial opening 130 extending upwardly and opening into the pole 230. In such embodiments, as shown in FIG. 7, the pole 230, which would be hollow, could further comprise, or be provided with, an upwardly extending pole extension 244 comprising water dispensing openings 248 along its length and/or at its free extremity 246. Understandably, when no pole extension 244 is present, the pole 230 could itself be provided with the water dispensing openings 248.

In such embodiments, the hollow pole 230/244 would form a third fluid path between the axial opening 130 and the water dispensing openings 248, thereby allowing water to flow from the axial opening 130 and through the pole 230/244 such as to be dispensed by the water dispensing openings 248 (see FIG. 7).

In the embodiment of FIG. 7, the free extremity 246 is configured as an umbrella and comprises the water dispensing openings 248. In such embodiments, both the platform 202 and the pole 230/244 would dispense water 250 and 252.

Understandably, to allow the water to flow from the axial bore 110, through the axial opening 130 and into the pole 230, the end cap 116 would be provided with an opening 132.

Understandably, with a rotating water play device in accordance with the principles of the present invention, the dispensing of the water while the platform is rotating under the action of at least one user will provide entertainment to the person or persons located on or around the device.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A rotating water play device comprising:

a) a shaft structure configured to be connected to a water source, the shaft structure comprising a base and a shaft extending from the base, the base being configured to be mounted to a surface, the shaft comprising an internal bore and at least one first radial opening in fluid communication with the bore, the shaft structure defining a first fluid path between the water source and the at least one first radial opening;

b) a platform assembly comprising a sleeve and a platform mounted to the sleeve, the platform being configured to support at least one user, the sleeve being mounted to the shaft for rotation, the sleeve comprising at least one second radial opening, the platform comprising at least one water dispensing opening in fluid communication with the at least one second radial opening, the sleeve and the platform defining a second fluid path between the at least one second radial opening and the at least one water dispensing opening;

wherein the at least one first radial opening and the at least one second radial opening are configured to be at least temporarily in registry when the sleeve of the platform assembly rotates about the shaft.

2. A rotating water dispensing device as claimed in claim 1, wherein the shaft comprises a circumferential groove which overlaps the at least one first radial opening.

3. A rotating water dispensing device as claimed in claim 1, wherein the sleeve comprises a circumferential groove which overlaps the at least one second radial opening.

4. A rotating water dispensing device as claimed in claim 1, wherein the shaft comprises a plurality of first radial openings.

5. A rotating water dispensing device as claimed in claim 1, wherein the sleeve comprises a plurality of second radial openings.

6. A rotating water dispensing device as claimed in claim 5, wherein the sleeve comprises a circumferential groove which overlaps the plurality of second radial openings.

7. A rotating water dispensing device as claimed in claim 5, wherein the platform comprises a plurality of water dispensing openings.

8. A rotating water dispensing device as claimed in claim 7, wherein the platform comprises a plurality of internal passages extending between the plurality of second radial openings and the plurality of water dispensing openings.

9. A rotating water dispensing device as claimed in claim 4, wherein the shaft comprises a circumferential groove which overlaps the plurality of first radial openings.

10. A rotating water dispensing device as claimed in claim 1, wherein the shaft comprises a plurality of first radial openings and the sleeve comprises a plurality of second radial openings.

11. A rotating water dispensing device as claimed in claim 1, wherein the platform comprises a periphery and wherein the at least one water dispensing opening is located at the periphery of the platform.

12. A rotating water dispensing device as claimed in claim 1, wherein the platform comprises a plurality of water dispensing openings.

13. A rotating water dispensing device as claimed in claim 12, wherein the platformH comprises a periphery and wherein the plurality of water dispensing openings are located along the periphery of the platform.

14. A rotating water dispensing device as claimed in claim 1, wherein the platform comprises at least one internal passage extending between the at least second radial opening and the at least one water dispensing opening.

15. A rotating water dispensing device as claimed in claim 14, wherein the at least one internal passage is at least one reservoir, at least one chamber, at least one conduit, or at least one channel.

16. A rotating water dispensing device as claimed in claim 1, wherein the platform assembly further comprises a pole.

17. A rotating water dispensing device as claimed in claim 16, wherein the pole comprises a handle.

18. A rotating water dispensing device as claimed in claim 16, wherein the shaft comprises at least one axial opening.

19. A rotating water dispensing device as claimed in claim 16, wherein the pole is in fluid communication with the at least one axial opening, wherein the pole comprises at least a second water dispensing opening, and wherein the pole defines a third fluid path between the at least one axial opening and the at least a second water dispensing opening.

20. A rotating water play device comprising:

a) a shaft structure configured to be connected to a water source, the shaft structure comprising a base and a shaft extending from the base, the base being configured to be mounted to a surface, the shaft comprising an internal bore and a plurality of first radial openings disposed about the shaft and in fluid communication with the bore, the shaft structure defining a first fluid path between the water source and the plurality of first radial openings;

b) a platform assembly comprising a sleeve and a platform mounted to the sleeve, the platform being configured to support at least one user, the sleeve being mounted to the shaft for rotation, the sleeve comprising a plurality of second radial openings disposed about the sleeve, the platform comprising a plurality water dispensing openings in fluid communication with the plurality of second radial openings, the sleeve and the platform defining a second fluid path between the plurality of second radial openings and the plurality water dispensing openings;

wherein the plurality of first radial openings and the plurality of second radial openings are configured to be at least temporarily in registry when the sleeve of the platform assembly rotates about the shaft.

21. A rotating water dispensing device as claimed in claim 20, wherein the shaft comprises a circumferential groove which overlaps the plurality of first radial openings.

22. A rotating water dispensing device as claimed in claim 20, wherein the sleeve comprises a circumferential groove which overlaps the plurality of second radial openings.

23. A rotating water dispensing device as claimed in claim 20, wherein the platform comprises a periphery and wherein the plurality of water dispensing openings are located along the periphery of the platform.

24. A rotating water dispensing device as claimed in claim 20, wherein the platform comprises a plurality of internal passages extending between the plurality of second radial openings and the plurality of water dispensing openings.

25. A rotating water dispensing device as claimed in claim 20, wherein the platform assembly further comprises a pole.

26. A rotating water dispensing device as claimed in claim 25, wherein the pole comprises a handle.

27. A rotating water dispensing device as claimed in claim 25, wherein the shaft comprises at least one axial opening.

28. A rotating water dispensing device as claimed in claim 27, wherein the pole is in fluid communication with the at least one axial opening, wherein the pole comprises at least a second water dispensing opening, and wherein the pole defines a third fluid path between the at least one axial opening and the at least a second water dispensing opening.

* * * * *